US007975512B2

(12) United States Patent
Weber et al.

(10) Patent No.: US 7,975,512 B2
(45) Date of Patent: Jul. 12, 2011

(54) HOOK NEEDLE WITH CANTED ELLIPTICAL CROSS-SECTION OF THE HOOK

(75) Inventors: Marcus Weber, Wegberg (DE); Valery Kapralov, Ivanovo (RU)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 12/550,818

(22) Filed: Aug. 31, 2009

(65) Prior Publication Data

US 2010/0050698 A1 Mar. 4, 2010

(30) Foreign Application Priority Data

Sep. 1, 2008 (EP) ..... 08163424

(51) Int. Cl.
*D04B 35/02* (2006.01)

(52) U.S. Cl. ..... 66/123
(58) Field of Classification Search ..... 66/116–124
See application file for complete search history.

(56) References Cited

U.S. PATENT DOCUMENTS

| | | | | |
|---|---|---|---|---|
| 62,382 | A * | 2/1867 | Wardwell | 66/119 |
| 2,685,787 | A * | 8/1954 | Noe | 66/121 |
| 2,854,836 | A * | 10/1958 | Morris | 66/121 |
| 4,178,781 | A * | 12/1979 | Virgilio et al. | 66/121 |
| 6,430,968 | B2 * | 8/2002 | Juenthner | 66/121 |

FOREIGN PATENT DOCUMENTS

| | | |
|---|---|---|
| DE | 611413 | 6/1932 |
| EP | 1449947 A1 | 8/2004 |
| GB | 475486 | 11/1937 |

OTHER PUBLICATIONS

European Search Report dated Jan. 29, 2009.

* cited by examiner

*Primary Examiner* — Danny Worrell
(74) *Attorney, Agent, or Firm* — Fitch, Even, Tabin & Flannery; Norman N. Kunitz

(57) ABSTRACT

A knitting machine needle having at least at one point S2, S3, S4 or S5 of its hook, a cross-section that is asymmetrical with respect to a longitudinal center plane M. Preferably, this cross-section is an oval cross-section and, more preferably, an elliptical cross-section. Using this measure, the robbing-back effect can be affected in a targeted manner during the knitting operation.

16 Claims, 3 Drawing Sheets

HOOK NEEDLE WITH CANTED ELLIPTICAL CROSS-SECTION OF THE HOOK

CROSS-REFERENCE TO RELATED APPLICATION

This application claims the benefit of foreign priority under 35 U.S.C. §119 based on European Patent application No. 08 163 424.8, filed Sep. 1, 2008, the entire disclosure of which application is hereby incorporated by reference.

BACKGROUND OF THE INVENTION

The invention relates to a knitting machine needle for loop-forming and knitting machines and, in particular, to a hook needle for circular knitting machines.

Hook needles for circular knitting machines have basically been known. They have a longitudinal shank that has a hook at one end. The hook is disposed to pick up a thread and, while forming a stitch, pull said thread through a stitch that is already seated on the shank. In order to enclose the picked-up thread in the hook, it is possible to provide additional means such as, for example, latches that are pivotally supported on the shank, sliders or the like.

If the knitting operation occurs serially in a row of stitches, a so-called robbing-back effect can be observed during the stitch-forming process. The knitting needle that is knitting pulls the picked-up thread through the older stitch seated on the shank and thus pulls along the thread. A half-stitch is formed, whereby both its tuck loops are located on both sides of the hook. One tuck loop transfers to the guided threads, whereas the other tuck loop transfers to the neighboring, just previously formed, half-stitch. Referring to this knitting operation, it may be observed that, during the formation of the new half-stitch, the thread tends to be pulled over from the just previously formed half stitch, which leads to a reduction in size of the older half-stitch. This effect is referred to as the "robbing-back effect" and may be undesirable.

Considering this, it is the object of the invention to provide a knitting machine needle with which the robbing-back effect can be influenced.

SUMMARY OF THE INVENTION

In accordance with the invention, the above object generally is achieved by a knitting machine needle that has a hook that is configured asymmetrically relative to a center axis. To accomplish this, the hook may have an oval cross-section in at least one region, said cross-section being oriented so as to be inclined relative to a transverse direction of the needle. As a result of this inclination of the inherently symmetrical cross-section relative to the longitudinal center plane containing the hook tip, it becomes possible to achieve the mentioned asymmetry of the hook cross-section.

This asymmetry has the effect that the curvature of the thread grasped by the hook—when a half stitch has formed—is different on both sides of the hook. At the start of the stitch formation, the oval and inclined hook cross-section at first results in a less pronounced looping and thus in a lower frictional force between the hook and the thread. Consequently, the stitch-forming operation is initially particularly gentle and easy on the thread. Additional following thread can very easily be pulled by the hook. If the long axis of the oval cross-section of the thread is aligned approximately parallel to the thread to be fed, i.e., if the angle subtended by the long axis of the oval cross-section and the transverse direction of movement of the needle opens toward the thread that is being fed, the stitch-forming operation is aided and the robbing-back effect is diminished.

However, the asymmetry of the hook cross-section can also be used, if desired, to increase the robbing-back effect, for example, if specifically very dense knit fabrics are to be manufactured.

Preferably, the needle in accordance with the invention is used in knitting machines with asymmetrically constructed cam assemblies as are mostly found in circular knitting machines. Such a circular knitting machine with asymmetrical cam assemblies is designed only for operation in one direction of rotation. The needles held by the needle cylinder or the dial always move in a prespecified transverse direction of the needle through the control cams of the cam assemblies. The stitch formation always occurs in the same direction. The thread is always supplied from the same side. For example, if the knitting cylinder—viewed from the top—rotates in counterclockwise direction, the oval cross-sections of the hooks—viewed in vertical section—are rotated by their large axes out of the horizontal in clockwise direction, i.e., their large axes drop down toward the right.

The inclined arrangement of the elongated oval hook cross-section in accordance with the invention leads to a desired distribution of the looping friction between the thread and the hook surface along the thread. The farther the knitting needles are retracted into their needle channel, the greater is the total looping, and thus the looping friction increases. In so doing, the inclined arrangement of the oval hook cross-section causes the thread end that is already being held by the produced knit fabric to be subjected to a greater looping friction than the free thread end that is connected to the thread supply. In order to achieve this, the long axis of the oval cross-section is arranged as ascending—viewed from the previously formed knit fabric. Due to the lower looping friction toward the thread supply and the greater looping friction toward the already formed knit fabric, the needle pulls the preferably set-up thread into the stitch to be formed and continues to pull less of the thread of the older adjacent stitch. Thus, the robbing-back effect has been diminished.

As mentioned, the opposing inclined arrangement of the oval cross-section can also be used to achieve an increased robbing-back effect, should this be desired.

The oval cross-section can be characterized by two axes, one of said axes having the largest diameter of the cross section and the other having the smallest diameter of the cross-section. The first axis marking the largest diameter is aligned so as to be inclined with respect to the transverse direction of the needle. The transverse direction of the needle is a direction that is perpendicular to the shanks of the knitting machine needle and thus perpendicular to the longitudinal direction of the needle. The longitudinal direction of the needle corresponds to the longitudinal direction of the shank of the knitting machine needle. Preferably, the shank is configured so as to be straight, i.e., in particular, the hook is neither bent laterally nor offset, or laterally bent out of the longitudinal direction of the needle in any other manner. In other words: there exists a longitudinal center plane on which is located a center line extending from the tip of the needle through the hook and the shank.

The acute angle $\alpha$ that is subtended by the first axis and the transverse direction of the needle preferably is in the range between 20° and 40°, and is preferably 30°. Consequently, considering most applications of the knitting machine needle, the first axis is essentially aligned parallel to the thread, thus creating the desired friction conditions. The acute angle $\alpha$ may also vary along the hook or be constant. If the acute angle α is constant along the hook cross-section, this is adequate in many applications to bring about the desired effect. However, it may also be practical to fix the acute angle in regions of the hook close to the tip, these potentially being viewed as the hook head, at a different value than the regions of the hook remote from the tip, these being located closer to the needle breast incline. For example, it may be practical to fix the acute angle α on the needle head at approximately 30°, whereas said angle may be smaller or, optionally, even larger in other regions.

Preferably the cross-sectional area of the asymmetrical hook cross-section decreases toward the hook tip. Optionally, the cross-sectional area may also be configured so as to match that of the hook at several points.

The asymmetrical cross-section may be configured as an elliptical cross-section. As explained above, it is asymmetrical due to its inclined position of the first axis (large axis) of the ellipse with respect to the transverse direction of the needle relative to the center plane. However, the elliptical cross-section in itself displays a symmetrical form. The elliptical form is symmetrical with respect to the first axis as well as with respect to the second axis. In addition, it is point-symmetric with respect to its center.

However, the oval cross-section may also display a lesser degree of symmetry. For example, said cross-section may be inherently asymmetrical in that it is egg-shaped, for example.

Additional advantageous details of the invention or other situations are the subject matter of the subclaims, the description or the drawings. In so doing, the drawings and the description are restricted to the illustration of essential elements of the invention, as well as miscellaneous situations. The drawings supplement the description of the exemplary embodiments.

DETAILED DESCRIPTION OF THE INVENTION

Figure 1:
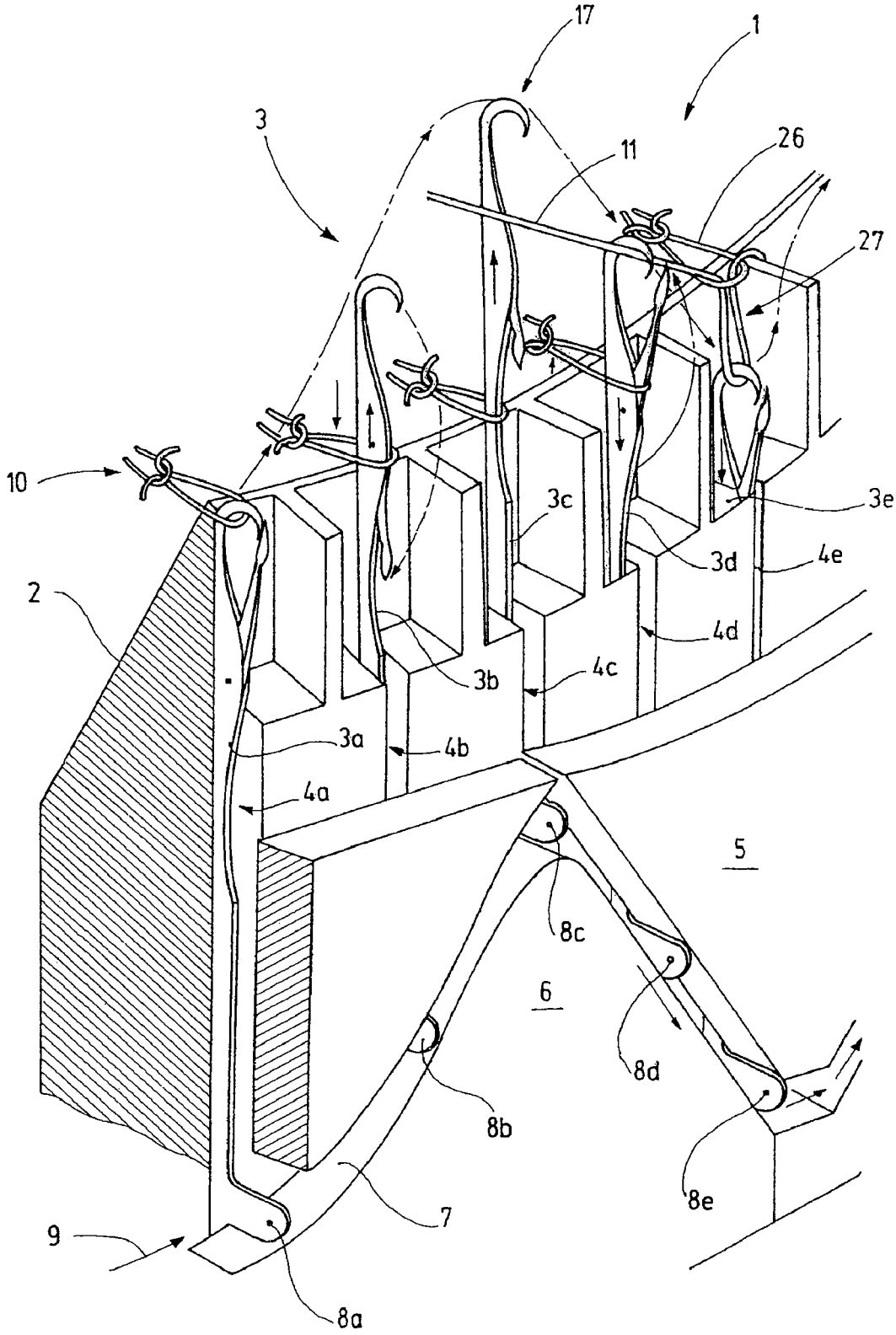
FIG. 1 is a schematic perspective depiction of a detail of a circular knitting machine to illustrate a knitting operation.

FIG. 1 shows a detail of a circular knitting machine 1, said machine comprising a knitting cylinder 2 in which knitting machine needles 3 in accordance with the invention are arranged. For differentiation, the knitting machine needles 3 have the letter indices a, b, c, d, e. Each of the knitting machine needles 3*a* through 3*e* has the same configuration, so that, hereinafter, the description of a single one of the knitting machine needle 3*a* through 3*e* will generally use the reference sign 3 when reference is made to the needle.

The needle cylinder 2 of the circular knitting machine 1 comprises needle channels 4*a* through 4*e*, which channels are arranged vertically along the barrel surface of the knitting cylinder and in which the knitting machine needles 3 can be slid in their respective longitudinal direction of the needles. The longitudinal direction of the needle corresponds to the vertical direction in FIG. 1. In order to move each knitting machine needle 3 a cam assembly 5 is provided, said assembly comprising at least one control cam 6, where legs 8 (8*a*-8*e*) of the knitting needles 3 slide along the curved surface 7 of said control cam, thus creating the longitudinal movement of the knitting machine needle 3. While the cam assembly 5 is in inoperative position, the knitting cylinder 2 rotates in the direction of the arrow 9, i.e., in counterclockwise direction in the exemplary embodiment in accordance with FIG. 1. The direction of motion of the knitting cylinder 2 is fixed and remains unchanged during operation. Utilizing this fact, the control cam 6 is optimized for the movement of the knitting machine needles 3 and is thus configured asymmetrically (i.e., one of its ascending flanks is different from its descending flank). The knitting machine needles carry a knit fabric 10, which is manufactured by continuously feeding a thread 11 to the knitting machine. Thread feeding takes place at a stationary location, while the knitting cylinder 2 and, with the latter, the knitting machine needle 3 are rotating.

Figure 2:
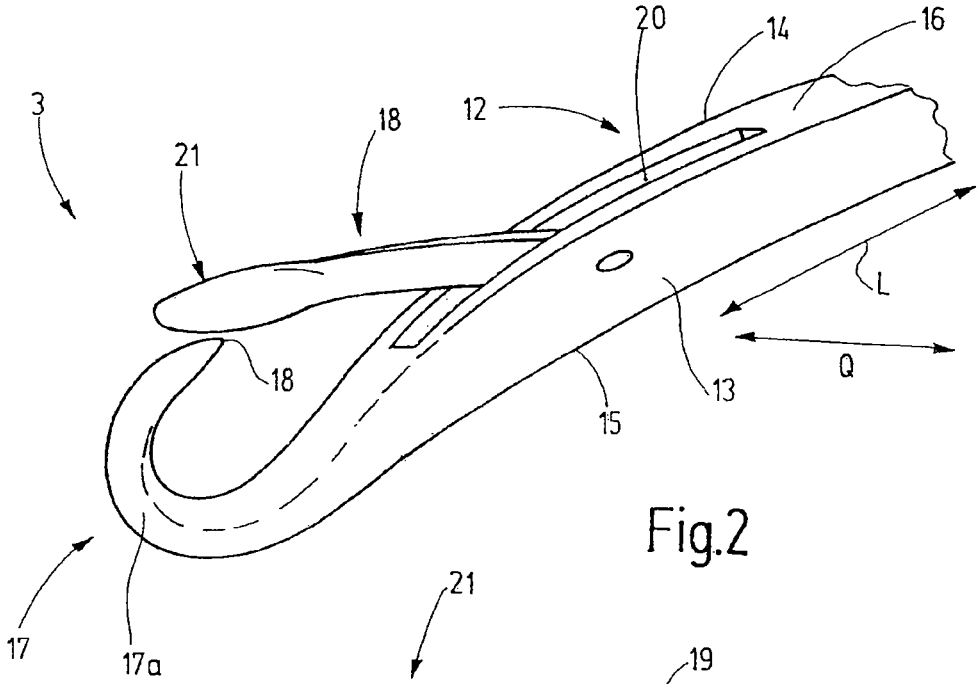
FIG. 2 is a perspective view of a detail of a machine knitting needle of the knitting machine in accordance with FIG. 1.

FIG. 2 illustrates the working part of one knitting machine needles 3. As is obvious, the knitting machine needle 3 has a straight shank 12 that extends parallel to a longitudinal direction L, as indicated by an arrow, said shank having at least one foot 8 (not illustrated) formed to it. The shank 12 is delimited by two essentially flat flanks 13, 14 that are arranged so as to be largely parallel to each other. The needle back 15 of the knitting machine needle 3 abuts against the bottom of each needle channel 15, whereas the upper side 16 of said needle extends radially outward.

On its end, the shank 12 has a hook 17 that ends in a tip 18. The hook 17 is associated with a latch 19 that is pivotally supported in the latch slit 20 and is disposed to open or close the hook 17. In so doing, one end 21 of the latch can abut against the end of the hook or pivot away from the hook 17.

Figure 3:
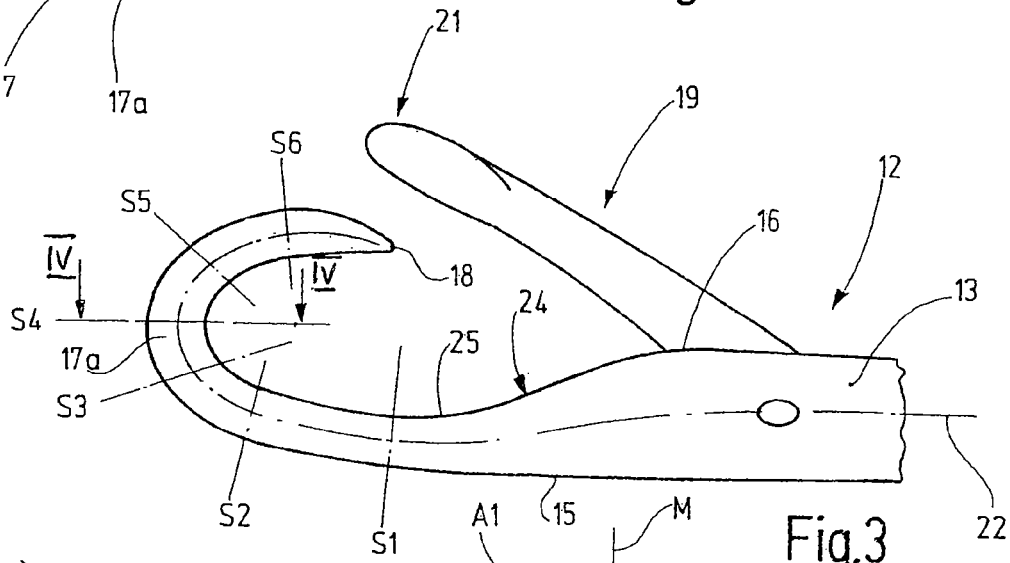
FIG. 3 is a side elevation of the machine knitting needle in accordance with FIG. 2.

As is obvious from FIG. 3, a center line 22 may be imagined extending through the shank 12, said center line extending as a curved line through the hook and intersecting the tip 18 of said hook. Preferably, the center line 22 is located in a plane that is parallel to the plane of projection in FIG. 3. This plane forms a center plane M that is indicated as a chain line in FIG. 4. The center plane extends centrally through the knitting machine needle 3 and its latch 19.

A particular feature of the knitting machine needle 3 in accordance with the invention is the configuration of its hook 17. Preferably, this hook has at least at one point, e.g., at its head 17*a*, an oval cross-section 23 that is inclined with respect to the transverse direction Q of the needle, as is obvious from FIG. 4. The head 17*a* is the part of the hook 17, in particular its U-shaped arc, located between the hook tip 18 and the needle back 15.

For further explanation, reference is first made to FIG. 3. In a breast incline region 24, the upper side 16 of the needle lowers toward the hook 17 at the beginning 25 of the hook 17. The cross-section of the needle may be round in the breast incline region 24 or it may be configured as a rectangular cross-section having rounded corners. At that point said cross-section is symmetrical with respect to the center plane M. However, in the hook 17, the cross-section may be asymmetrical, at least at one point, with respect to the center plane M. For clarification, FIG. 3 indicates various intersection lines S1, S2, S3, S4, S5, S6. For example, considering intersection line S1, there may be a round, essentially circular, cross-section that, in S2, terminates in an oval cross-section in a part of the hook 17 that is farther away from the breast incline region 24. In addition, the oval cross-section may exist at the intersection lines S3, S4, S5 and, for example, at S6, i.e., approaching the needle tip 18, terminate in a round cross-section off and on.

Figure 4:
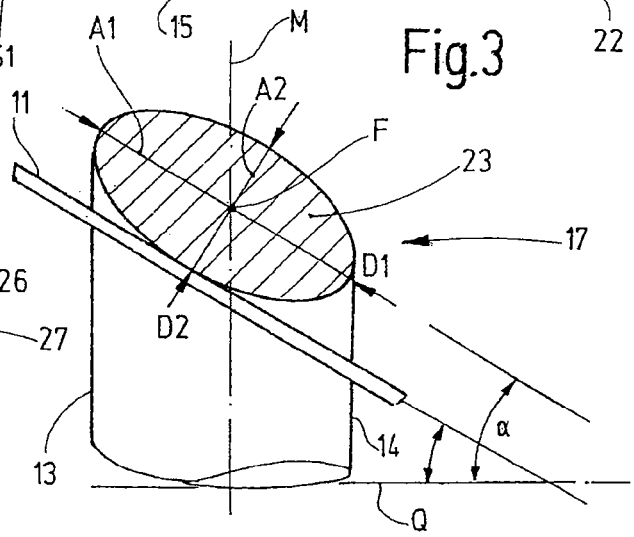
FIG. 4 is a sectional view, along the line IV-IV in FIG. 3, of the machine knitting needle in accordance with FIG. 3.

FIG. 4 shows a hook, in section as in the case of the intersection line S4, with the viewing direction being indicated by the arrows in accordance with FIG. 3. As is obvious, the oval cross-section is depicted here as an elliptical cross-section. The centroid F of this ellipse is on the center plane M. The centroid F is the center of the elliptical cross-section 23. The direction of the largest diameter D1 of the cross-section (e.g., ellipse) defines a first axis A1. The direction of the smallest diameter D2 defines a second or small axis. Both axes A1, A2 pass through the centroid F.

As is obvious, the first axis A1 is inclined at an angle α with respect to the transverse direction Q of the needle, said direction being perpendicular to the longitudinal center plane M. Preferably, the acute angle α is 30°. However, said angle may also deviate therefrom; however, it is preferably at least within the range of 20° to 40°. The first axis A1 is preferably aligned so as to be parallel to the thread 11 when the knitting machine needle 3 is in driven-out position in accordance with the positions of the needles 3*c*, 3*d* in FIG. 1.

Figure 6:
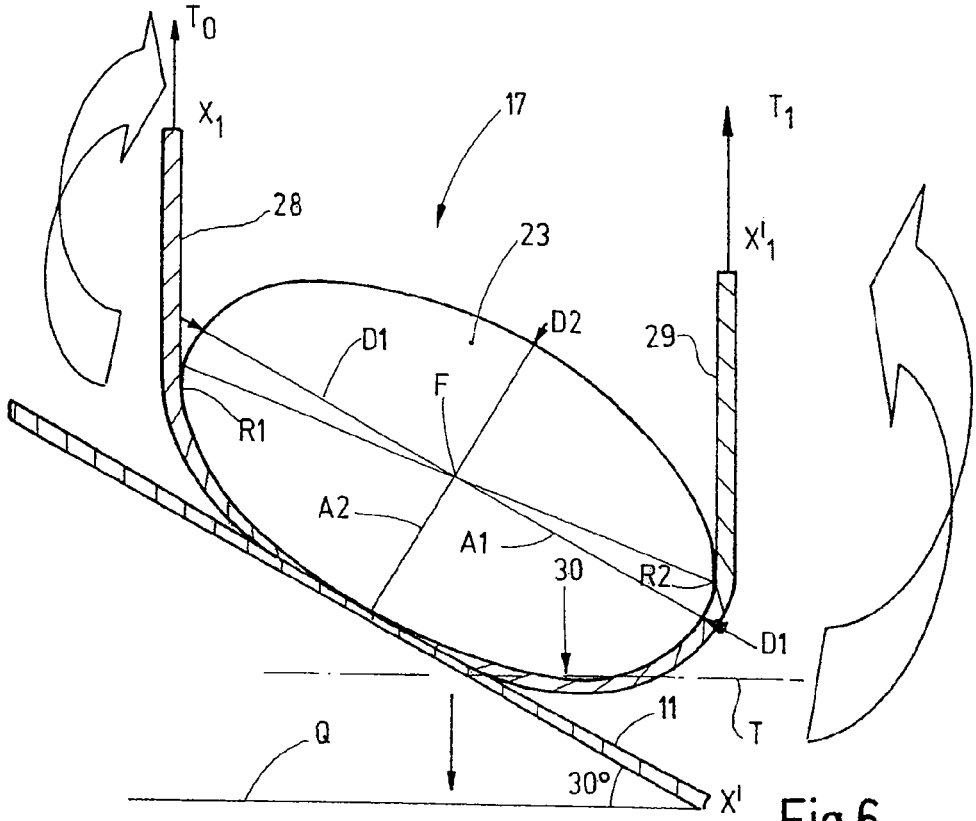
FIG. 6 is a schematic illustration of the looping conditions of a knitting machine needle having an elliptical hook cross-section, in various stages of the knitting process.

The described conditions apply to the hook 17 on the hook head 17*a*, i.e., at the point of the intersection line S4 that extends essentially parallel to the needle back 15 and thus extends approximately parallel to the longitudinal direction L. Preferably, the explanations also apply, accordingly, to the cross-section of the hook 17 at the points of the intersection lines S2, S3, S5 in the vicinity of the intersection line S4. In so doing, the hook has, on the side facing the incoming thread 11, a more widely opened edge R1 (in FIGS. 4, 6, 7, on the left side) than on its opposite side (edge R2 in FIGS. 4, 6, 7, on the right side). Each of the edges R1 and R2 is respectively followed by the curvature of the hook 17 and the center line 22. The center line passes through the centroids F of all cross-sections. The radius of curvature of the edge R1 is preferably greater than the radius of curvature of the edge R2. The radius of curvature of the center line 22 is preferably located between the radii of curvature of R1 and R2. The tangents on the edges R1, R2 are parallel to the center plane M.

The knitting machine needle 3 described so far works as follows:

With the knitting cylinder 2 rotating, the knitting machine needles 3 are carried along in a circle with the knitting cylinder 2. Their feet 8 move along the curved path 7 of the control cam 6, whereby the knitting machine needles 3 are driven out, one after the other, at the stationary thread-feeding location. In FIG. 1, the knitting machine needles 3*a*, 3*b*, 3*c* move outward in the driving-out directions, whereby the knitting machine needle 3*c* has just reached its point of return. Its hook 17 is positioned above the thread 11, catching it when the needle moves downward, as the previous needles 3*e* and 3*d* have done already. In so doing, the thread 11 held in the hook 17 is again pulled through an older stitch 26 that has been previously pulled onto the shank of the knitting machine needle 3*e*.

Figure 5:
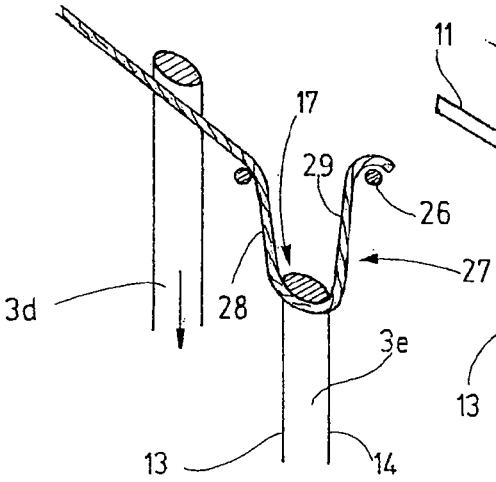
FIG. 5 shows two needles during a knitting operation, where their hooks are sectioned along the line IV-IV in FIG. 3.

FIG. 5 again illustrates the process the individual steps of the operation. Considering the knitting machine needle 3*e*, it is obvious that the just formed half stitch 27 has two legs 28, 29 that encounter different friction conditions due to the different widths of the edges R1, R2 of the hook 17. This also becomes obvious from FIG. 6 that illustrates the conditions on an enlarged scale and, optionally, somewhat idealized. Referring to the cross-section 23 illustrated there, a point 30 is marked at which the tangent T applied to the inside surface of the hook is parallel to the transverse direction Q. Extending from this point, the path displays less curvature to the tuck loop 28 than to the tuck loop 29. The friction conditions that are encountered by the tuck loop 29 on the hook 17 thus differ somewhat from the friction conditions encountered by the tuck loop 28. While the thread 11 in FIG. 1 can very easily be pulled through the old stitch 26, the thread, in so doing, is hardly retracted by the previously already produced half stitch 27. Consequently, once half stitches of the knit fabric have been formed they are not made smaller in a detrimental manner.

Figure 7:
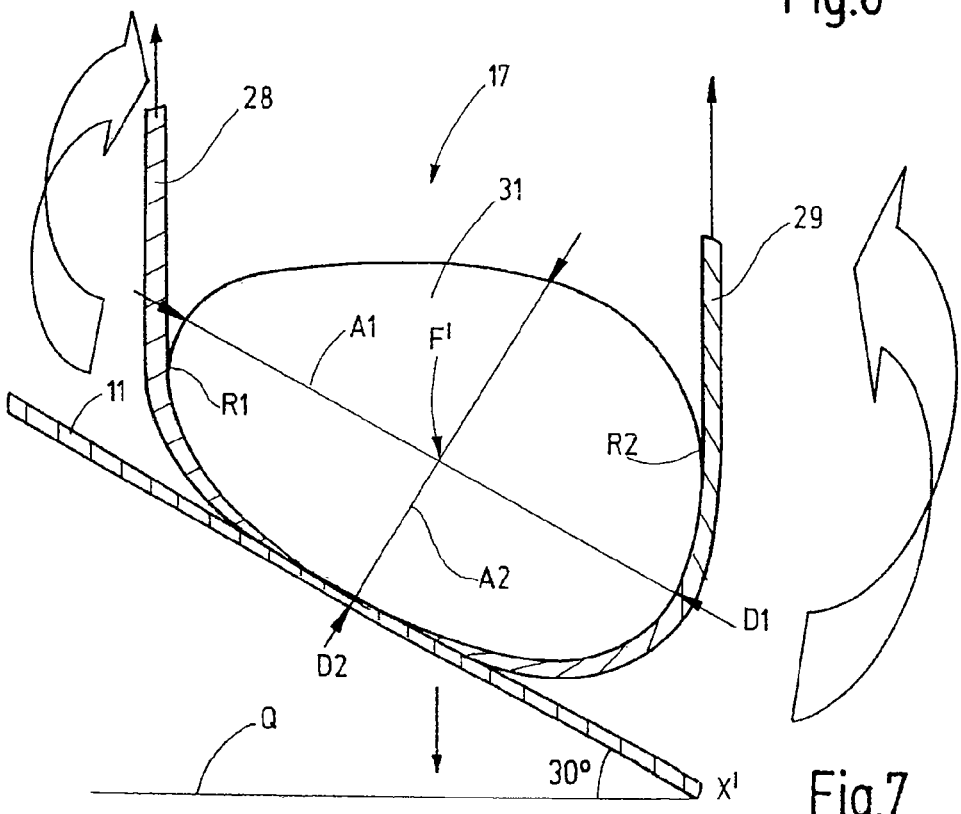
FIG. 7 illustrates the looping conditions on a knitting machine needle having an egg-shaped hook cross-section, in various stages of the knitting operation.

The effect can also be generated with oval cross-sections or other asymmetrical cross-sections that deviate from the elliptical form. FIG. 7 shows such an exemplary embodiment. The non-circular cross-section 31 of the hook 17 has a centroid F'. Passing through it, again, the largest diameter D1 and the smallest diameter D2 can be determined, these, in turn, forming the first axis A1 and the second axis A2. Again, the large axis A1 is inclined toward the transverse direction Q at an acute angle of preferably 30°. Again, the edge R1 facing the incoming thread 11 is wider than the edge R2 that is on the outgoing side of the thread. In so doing, the edges R1 and R2 are those locations along the hook 17, at which the hook surface is parallel to the longitudinal center plane M.

In accordance with the invention, a knitting machine needle is being suggested, said needle having at least at one point S2, S3, S4 or S5 of its hook a cross-section that is asymmetrical with respect to a longitudinal center plane M. Preferably, this cross-section is an oval cross-section and, more preferably, an elliptical cross-section. Using this measure, the robbing-back effect can be affected in a targeted manner during the knitting operation.

It will be appreciated that the above description of the present invention is susceptible to various modifications and changes, and the same are intended to be comprehended within the meaning and range of equivalents of the appended claims.

LIST OF REFERENCE NUMERALS

1 Knitting machine
2 Knitting cylinder
3 Knitting machine needles (3*a* . . . 3*e*)
4 Needle channels (4*a* . . . 4*e*)
5 Cam assembly
6 Control cam
7 Curved surface
8 Foot (8*a* . . . 8*e*)
9 Arrow
10 Knit fabric
11 Thread
12 Shank
L Longitudinal direction
13, 14 Flanks
15 Needle back
16 Needle breast
17 Hook
17*a* Head
18 Tip
19 Latch
20 Latch slit
21 End
22 Center line
M Center plane
Q Transverse direction of needle
23 Cross-section

24 Breast incline region
25 Start of the hook 17
S1-S6 Intersection lines
F, F' Centroid
D1 Largest diameter
A1 First axis
D2 Smallest diameter
A2 Second axis
α Acute angle between the transverse direction of the needle and the first axis
26 Older stitch
27 Half stitch
28, 29 Legs
30 Point at which the tangent T is parallel to the transverse direction Q.
31 Cross-section
F' Center of area/centroid
T Tangent
R1, R2 Edge

What is claimed is:

1. Knitting machine needle with a longitudinal shank having parallel flanks and defining a longitudinal direction (L) and a transverse direction (Q) of the needle that is provided with a hook, wherein the hook has, at least at one point (S4), a cross-section that is asymmetrical with respect to a longitudinal center plane (M) disposed parallel to the flanks of the shank and midway between the flanks.

2. Knitting machine needle as in claim 1, wherein the cross-section is an oval cross-section.

3. Knitting machine needle as in claim 2, wherein the cross-section has, in a first axis (A1), a largest diameter (D1) and, in a second axis (A2), a smallest diameter (D2), said first axis and the transverse direction (Q) of the needle subtending an acute angle (α).

4. Knitting machine needle as in claim 2, wherein the cross-section is aligned at an acute angle (α) so as to be inclined relative to the transverse direction of the needle, said angle being between 20° and 40°.

5. Knitting machine needle as in claim 3, wherein the acute angle (α) varies along the hook.

6. Knitting machine needle as in claim 3, wherein the acute angle (α) is constant along the hook.

7. Knitting machine needle as in claim 2, wherein the hook has an arcuate section that continuously has the oval cross-section.

8. Knitting machine needle as in claim 2, wherein the oval cross-section is formed on a hook head section.

9. Knitting machine needle as in claim 3, wherein the direction of inclination of the first axis (A1) is defined as a function of the direction of movement of the needle.

10. Knitting machine needle as in claim 3, wherein the acute angle (α) is open toward a thread-guide side of the knitting machine needle.

11. Knitting machine needle as in claim 3, wherein the oval cross-section is an elliptical cross-section.

12. Knitting machine needle as in claim 11, wherein the first axis (A1) is the large elliptical axis, and the second axis (A2) is the small elliptical axis.

13. Knitting machine needle as in claim 11, wherein the hook has a tip, and the oval cross-section decreases toward the tip of the hook.

14. Knitting machine needle as in claim 13, wherein the tip has a round cross-section.

15. Knitting machine needle as in claim 1, wherein a latch is arranged in the vicinity of the hook.

16. Knitting machine needle as in claim 1, wherein the cross section is perpendicular to a longitudinally extending centerline of the needle.

* * * * *